US005685787A

United States Patent [19]

Kogut

[11] Patent Number: 5,685,787

[45] Date of Patent: Nov. 11, 1997

[54] GOLF CLUB SWING TRAINING METHOD

[76] Inventor: Christopher Mark Kogut, 36 West Rd., Ellington, Conn. 06029

[21] Appl. No.: 675,048

[22] Filed: Jul. 3, 1996

[51] Int. Cl.[6] ..... A63B 69/36

[52] U.S. Cl. ..... 473/409; 473/205; 473/212

[58] Field of Search ..... 473/61, 212, 213, 473/409, 205

[56] References Cited

U.S. PATENT DOCUMENTS

| | | | |
|---|---|---|---|
| 1,126,938 | 2/1915 | Barrett | 473/61 X |
| 2,709,257 | 5/1955 | McKinney | 473/61 X |
| 2,827,635 | 3/1958 | Rasmus | 473/61 X |
| 5,064,198 | 11/1991 | Szabo | 473/213 |

*Primary Examiner*—George J. Marlo

[57] ABSTRACT

The invention relates to a golf accessory item and method that provides a taut, strap-like connection between the thumb and the wrist extending across the backside of the following hand. The invention helps a golfer with the proper positioning of the thumb on the golf club and, more importantly, helps maintain a strong, solid grip throughout the golf swing.

2 Claims, 2 Drawing Sheets

GOLF CLUB SWING TRAINING METHOD

REFERENCES CITED

U.S. Patent Documents
5,414,868 May 16, 1995 Individually Owned 2/160
5,895,268 Mar. 22, 1994 Individually Owned 2/17

BACKGROUND OF THE INVENTION

This invention relates in general to golf accessory items. More specifically, it is a golf grip aid. First and foremost, the invention helps with the proper positioning of the "strong hand" thumb on the golf grip. For a right handed golfer the "strong hand" would be the right or following hand. Amateur golfers typically use a baseball style grip with the thumb under, pinching the club instead of laying on top or over the club. The UNI-GRIP 2000+ promotes proper thumb placement. Secondly, yet more importantly, the tension created by the strap connection between the THUMB and the WRIST promotes a solid grip throughout the golf swing. Speaking from my own golf swing, I often, subconsciously loosen my grip during the backswing, perpetuating an insecure downswing and often resulting in an errant shot. The UNI-GRIP 2000+ rectifies this. Thus, in summary, use the UNI-GRIP 2000+, feel the tautness, your thumb will be positioned correctly and your grip will remain solid.

U.S. Pat. No. 5,414,868, as cited in my reference, has a prior art device showing two straps fixed to a golf glove mating at the backside of the glove body. As yet, there have been no inventions detailing the direct taut connection between the THUMB and the WRIST, and the importance/advantages thereof.

Prior to my invention, the GOLFER had no such device and simply had to do without until HE/SHE learned the proper "feel of the swing" through lessons and/or years of practice.

BRIEF SUMMARY OF THE INVENTION

The UNI-GRIP 2000+ Golf Accessory is a strap-like device that loops around your thumb, extends across the backside of your hand, and attaches to your wrist by means of a releasably fastened material otherwise known as "VELCRO". The purpose of said device is twofold. One, it promotes the proper positioning of the thumb on top of the golf club and two, because of the taut, strap tension between the thumb and the wrist, it helps maintain a strong, solid grip throughout the golf swing.

The simplicity and intended use of the invention is easy to see from the drawings included and from the description above and throughout this patent application.

DETAILED DESCRIPTION OF THE DRAWINGS

Figure 2:
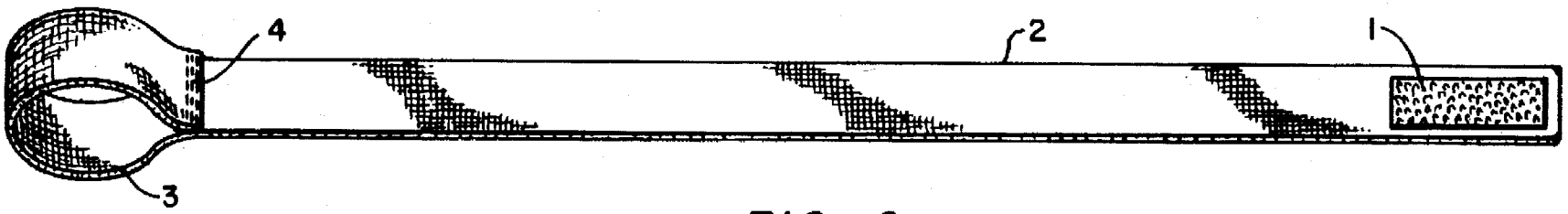
FIG. 2 is a reduced scale, front perspective of the UNI-GRIP 2000+ flipped over

Referring first to FIG. 2 we have a front perspective of the UNI-GRIP 2000+ flipped over. This figure best shows all of the elements that comprise the UNI-GRIP 2000+ which I have identified with the numerals 1, 2, 3, 4. Number 1 is best described as a conventional fastening device embodying such hook-like members, commonly sold under the trade name "VELCRO". Number 2 is a strap-like material of which I have choosen a cotton, nylon blend because the "VELCRO" piece, 1, readily adheres to it securely without requiring the mating "VELCRO" felt-like member. Number 3 is a simple loop formed by rolling over the strap-like material, 2, and thread stiching as indentified by 4.

Figure 3:
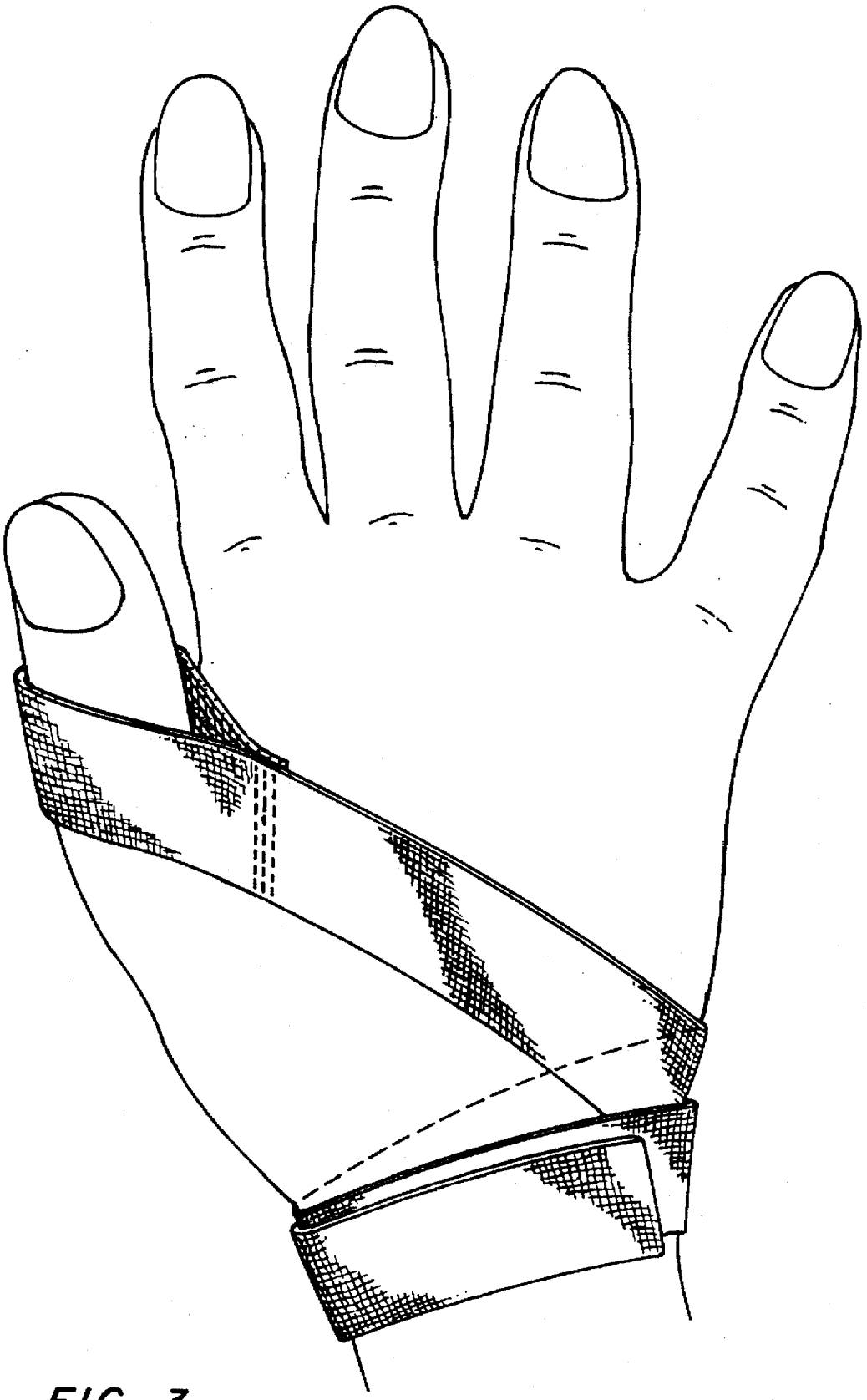
FIG. 3 shows the UNI-GRIP 8000+ placement on hand

Making the UNI-GRIP 2000+ is straightforward. Start by selecting a strap-like material, 2 of FIG. 2, of sufficient length to wear as shown in FIG. 3. Adhere the "VELCRO" piece, 1 of FIG. 2, to one end of the strap, 2 of FIG. 2, and sew a loop on the other end of the strap, identified by 2, 3 and 4 of FIG. 2.

Figure 1:
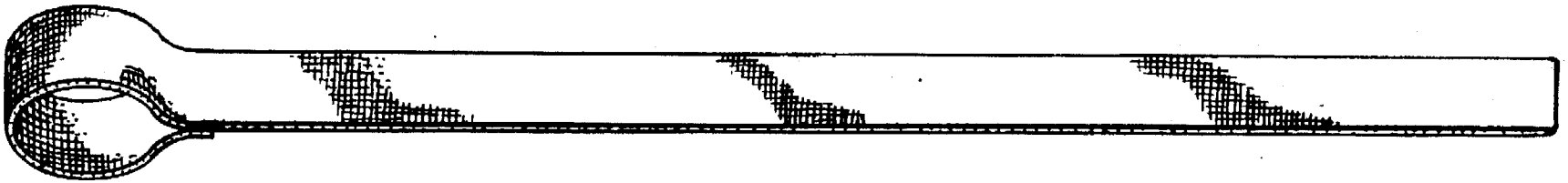
FIG. 1 is a reduced scale, front perspective of the UNI-GRIP 2000+

FIG. 3. shows the UNI-GRIP 2000+ placement on the hand. The UNI-GRIP 2000+, held exactly as shown in FIG. 1, is first looped around the thumb, as shown in FIG. 3, then pulled tautly across the backside of the handy and wrapped around the wrist, (clockwise for a right handy counter clockwise for a left hand), until the "VELCRO" piece, I of FIG. 2, can securely attach to the strap-like material, 2 of FIG. 2, holding it with tension. To remove the UNI-GRIP 2000+, simply reverse the order above, starting by unsecuring the releasably fastened "VELCRO" piece, 1 of FIG. 2.

Other variations of said invention include a releasably fastened, strap to thumb attachment, allowing for a variable, snug, fit around thumb; using an alternate strap-like material, and/or making the strap partially/fully rigid; using a simple, pin, clip or buckle to secure to wrist; incorporating the UNI-GRIP 2000+ as part of a golf glove, and/or using wrist padding. These variations and other obvious improvements are all intended to be covered by my subsequent CLAIM.

I claim:

1. A method for training a golfer to swing a golf club comprising the steps of, (a) inserting the thumb of the following hand into a loop having a circumference sufficient to encircle the thumb of said hand, (b) pulling an elongated strap, having one end secured to said loop, tautly across the back of said hand and securing the other end of said strap to the wrist of said hand such that tension is created by said strap between said thumb and said wrist when said hand is gripping a golf club, and (c) gripping and swinging a golf club such that the tension in said strap maintains a strong solid grip throughout the swing.

2. The method of claim 1 wherein said other end of said strap is wrapped around a golfer's wrist multiple times and secured to itself at no exact predetermined location whereby accommodating wrists of varying sizes.

* * * * *